US011480031B2

(12) United States Patent
Gallagher et al.

(10) Patent No.: US 11,480,031 B2
(45) Date of Patent: Oct. 25, 2022

(54) PRESSURE CONTROL DEVICE WITH SAFETY LOCKING MECHANISM

(71) Applicant: Kinetic Pressure Control, Ltd., Houston, TX (US)

(72) Inventors: Bobby Gallagher, Houston, TX (US); Steven A. Angstmann, Houston, TX (US); Billy Gallagher, Houston, TX (US)

(73) Assignee: Kinetic Pressure Control Ltd., Houston, TX (US)

( * ) Notice: Subject to any disclaimer, the term of this patent is extended or adjusted under 35 U.S.C. 154(b) by 0 days.

(21) Appl. No.: 17/280,704

(22) PCT Filed: Oct. 21, 2019

(86) PCT No.: PCT/US2019/057278
§ 371 (c)(1),
(2) Date: Mar. 26, 2021

(87) PCT Pub. No.: WO2020/086486
PCT Pub. Date: Apr. 30, 2020

(65) Prior Publication Data

US 2021/0340842 A1 Nov. 4, 2021

Related U.S. Application Data

(60) Provisional application No. 62/751,230, filed on Oct. 26, 2018.

(51) Int. Cl.
*E21B 34/16* (2006.01)

(52) U.S. Cl.
CPC ..... *E21B 34/16* (2013.01)

(58) Field of Classification Search
CPC ..... E21B 34/16
See application file for complete search history.

(56) References Cited

U.S. PATENT DOCUMENTS

| | | | |
|---|---|---|---|
| 8,316,872 | B1 | 11/2012 | Milanovich |
| 8,567,427 | B1 | 10/2013 | Milanovich |
| 8,794,308 | B1 | 8/2014 | Milanovich |
| 2012/0055679 | A1 | 3/2012 | Van Winkle |
| 2017/0362911 | A1 | 12/2017 | Read et al. |
| 2018/0080300 | A1 | 3/2018 | Angstmann et al. |

OTHER PUBLICATIONS

Written Opinion of the International Search Authority, International Application No. PCT/US2019/057278, dated Feb. 7, 2020.
International Search Report, International Application No. PCT/US2019/057278, dated Feb. 7, 2020.

*Primary Examiner* — Taras P Bemko
(74) *Attorney, Agent, or Firm* — Victor H. Segura

(57) ABSTRACT

A well pressure control device includes a housing having a through bore. A pressure chamber has a piston movably disposed therein. The pressure chamber is coupled at one end to the housing transversely to the through bore. The actuating piston defines a pressure source side and a through bore side of the pressure chamber. A fluid pressure source is coupled to the other end of the pressure chamber. A closure element is disposed in the pressure chamber on the through bore side. At least one locking element is coupled to the pressure chamber at an axial position along the pressure chamber on the through bore side.

12 Claims, 4 Drawing Sheets

PRESSURE CONTROL DEVICE WITH SAFETY LOCKING MECHANISM

CROSS REFERENCE TO RELATED APPLICATIONS

Continuation of International Application No. PCT/US2019/057278 filed on Oct. 21, 2019. Priority is claimed from U.S. Provisional Application No. 62/751,230 filed on Oct. 26, 2018. Both of the foregoing applications are incorporated herein by reference in their entirety.

BACKGROUND

This disclosure relates to the field of well pressure control apparatus, namely, blowout preventers (BOPs).

Blowout preventers (BOPs) for oil and gas wells are used to prevent potentially catastrophic events known as a blowouts, where high well pressures and uncontrolled flow from a subsurface formation into the well can expel tubing (e.g., drill pipe and well casing), tools and drilling fluid out of a well. Blowouts present a serious safety hazard to drilling crews, the drilling rig and the environment and can be extremely costly. Typically BOPs have "rams" that are opened and closed by actuators. The most common type of actuator is operated hydraulically to push closure elements across a through bore in a BOP housing (itself sealingly coupled to the well) to close the well. In some cases, the rams have hardened steel shears to cut through a drill string or other tool or device which may be in the well at the time it is necessary to close the BOP.

A limitation of many of the hydraulically actuated rams is that they require a large amount of hydraulic force to move the rams against the pressure inside the wellbore and subsequently to cut through objects in the through bore. An additional limitation of hydraulically actuated rams is that the hydraulic force is typically generated at a location away from the BOP (necessitating a hydraulic line from the pressure source to the rams), making the BOP susceptible to failure to close if the hydraulic line conveying the hydraulic force is damaged. Further problems may include erosion of cutting and sealing surfaces due to the relatively slow closing action of the rams in a flowing wellbore. Cutting through tool joints, drill collars, large diameter tubulars and off center pipe strings under heavy compression may also present problems for hydraulically actuated rams.

Kinetic based BOPs have been proposed which address certain shortcomings of hydraulic BOPs such as are described in International Application Publication No. WO/2016 176725 to Kinetic Pressure Control Limited. Typically, such kinetic BOPs comprise a pyrotechnic charge to generate gas pressure, which pressure against to drive a piston. The piston subsequently drives a closure element such as a shear ram. Such BOPs also comprise a through bore sealing arrangement to stop the passage of well fluids when the closure element is moved across the through bore. In the event of failure of the sealing arrangement it is possible that high pressure well fluids could react against piston. In such an event, the firing piston would reopen and allow the passage of well and other fluids through the through bore, which could result in a catastrophic blowout.

It is desirable that a kinetic BOP would not reopen unless an intentional sequence for opening the devise was initiated.

SUMMARY

A well pressure control device according to the present disclosure includes a housing having a through bore. A pressure chamber has a piston movably disposed therein. The pressure chamber is adjacent to one end of the housing transversely to the through bore. A fluid pressure source is disposed at one end of the pressure chamber. A closure element is disposed in the pressure chamber. At least one locking element is disposed at an axial position along the pressure chamber and configured to move into a travel path of the closure element when the closure element is moved toward the through bore.

In some embodiments, the at least one locking element comprises a locking piston disposed in a lock housing.

In some embodiments, the locking piston has a through hole whereby fluid pressure in the pressure chamber is conducted to one side of the locking piston defining an actuation chamber.

Some embodiments further comprise a reopening chamber defined by the locking piston and the lock housing on a side of the locking piston opposed to the actuation chamber.

In some embodiments, the fluid pressure source comprises a pyrotechnic gas generator charge.

Some embodiments further comprise indicator means configured to provide an indication of the position of the locking piston.

In some embodiments, at least one edge of the locking piston comprises a shearable plate.

In some embodiments, the reopening chamber is larger than the actuation chamber.

A method for operating a well pressure control device according to another aspect of the disclosure includes applying fluid pressure to at least one closure element in a pressure chamber to urge the at least one closure element toward a through bore in a pressure control housing. At a selected position along a travel path of the at least one closure element, some of the fluid pressure is diverted to at least one locking element disposed along the pressure chamber. The at least one locking element is moved into the travel path behind the at least one closure element.

In some embodiments, the at least one locking element comprises a locking piston disposed in a lock housing.

In some embodiments, the locking piston has a through hole whereby fluid pressure in the pressure chamber is conducted to one side of the locking piston in a lock housing.

Some embodiments further comprise applying fluid pressure to a reopening chamber defined by the locking piston and the lock housing.

In some embodiments, the applying fluid pressure comprises actuating a pyrotechnic charge.

In some embodiments, one side of the locking piston defines an actuation chamber which is smaller than the reopening chamber.

In some embodiments, the lock housing comprises indicator means configured to provide an indication of the position of the locking piston.

In some embodiments, at least one edge of the locking piston comprises a shearable plate.

DETAILED DESCRIPTION

Figure 1:
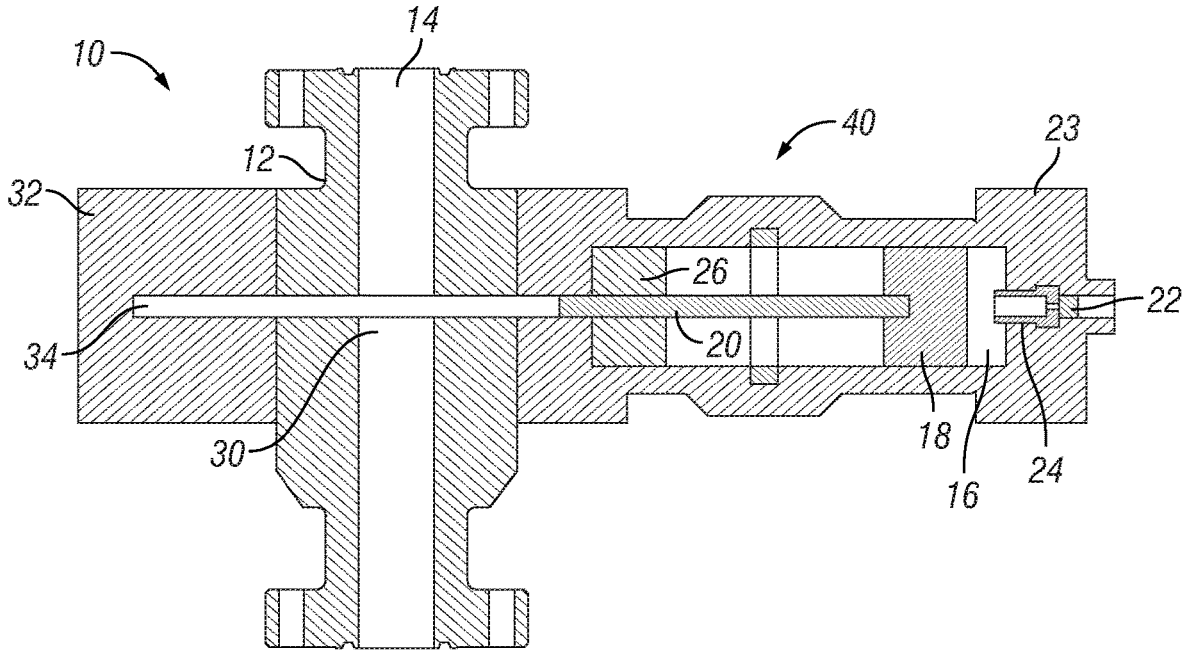
FIG. 1 shows a kinetic BOP having a locking mechanism according to the present disclosure prior to actuation of a closure element actuator.

Illustrative embodiments are disclosed herein. In the interest of clarity, not all features of an actual implementation are described. In the development of any such actual implementation, numerous implementation-specific decisions may need to be made to obtain design-specific goals, which may vary from one implementation to another. It will be appreciated that such a development effort, while possibly complex and time-consuming, would nevertheless be a routine undertaking for persons of ordinary skill in the art having the benefit of this disclosure. The disclosed embodiments are not to be limited to the precise arrangements and configurations shown in the figures, in which like reference numerals may identify like elements. Also, the figures are not necessarily drawn to scale, and certain features may be shown exaggerated in scale or in generalized or schematic form, in the interest of clarity and conciseness.

FIG. 1 shows a side view of a BOP having a locking mechanism according to the present disclosure. In the present example embodiment, the BOP may be a pyrotechnic, gas operated. A non-limiting example of such a pyrotechnic, gas operated BOP is described in International Application Publication No. WO 2016/176725 filed by Kinetic Pressure Control Limited.

The BOP 10, which may also be referred to as a "kinetic BOP" comprises a BOP housing 12 having a through bore 14. The BOP housing 12 may be coupled to a wellhead, another BOP or a similar structure so that any such structure may be closed to fluid flow by operating the BOP 10. A passageway 34 may be formed in a receiving cover 32 coupled to one side of the BOP housing 12. Part of such passageway 34 may be formed within the BOP housing 12. A further part of the passageway 34 may be formed in a pressure chamber 16 coupled to an opposed side of the BOP housing 12. The pressure chamber 16 may extend from the BOP housing 12 to an end cap 23 disposed on the opposed end of the pressure chamber 16.

The passageway 34 and the above-described parts of the passageway 34 provide a travel path for a closure element, which in the present example embodiment may be a ram 20. In the present example embodiment, the ram 20 may be a shear ram. The travel path in the present example embodiment enables the ram 20 to attain sufficient velocity resulting from actuation of a fluid pressure source such as a pyrotechnic charge 24, and subsequent gas expansion against an actuating piston 18, such that kinetic energy imparted to the ram 20 may be sufficient to sever any device disposed in the through bore 14 and to enable the ram 20 to extend into the passageway 34 across the through bore 14. A seal 30 may provide effective flow closure between the through bore 14 and the ram 20 when the ram 20 is moved into the through bore 14 such that fluid pressure in the through bore 14 is excluded from the passageway 34 and is prevented from traversing the ram 20 segment disposed in the through bore 14. When the ram 20 is disposed across the through bore 14 after actuation of the pyrotechnic charge 24, the through bore 14 is thereby effectively closed to flow across the ram 20 and into the BOP housing 12. The actuating piston 18 may be decelerated by a brake 26 such as a crush sleeve or similar device such that the actuating piston 18 does not strike the BOP housing 12 so as to damage the BOP housing 12. The pyrotechnic charge 24 may be actuated by an initiator 22 of types well known in the art.

The embodiment shown in FIG. 1 comprises the actuating piston 18 and ram 20 to obtain two results. First, the force generated by reason of pressure from the pyrotechnic charge is maximized, and second, conversion of such force into power to shear through any objects in the through bore 14 is maximized by suitably shaping the ram 20. It should be clearly understood that such features are not required in order to obtain the proposed function of a pressure control device according to the present disclosure. For example, the actuating piston and the ram may be combined as a single device or element suitably shaped to be operable by pressure from the pyrotechnic charge or other source of pressure, as well as to suitably close the through bore 14.

A locking mechanism 40 may be disposed at a selected axial position along the pressure chamber 16. In some embodiments, the selected axial position is such that locking elements to be explained in more detail with reference to FIGS. 2 and 3 may be actuated to retain the actuating piston 18 and consequently the ram 20 in their respective axial positions when the actuating piston 18 and ram have been moved sufficiently such that the ram 20 traverses the through bore 14 and closes the through bore 14 to fluid flow across the ram 20.

Figure 2:
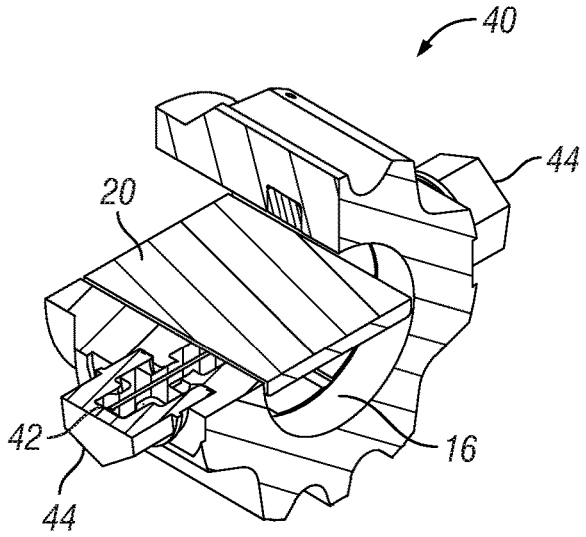
FIG. 2 shows an oblique view of the locking mechanism for the BOP in FIG. 1.
Figure 3:
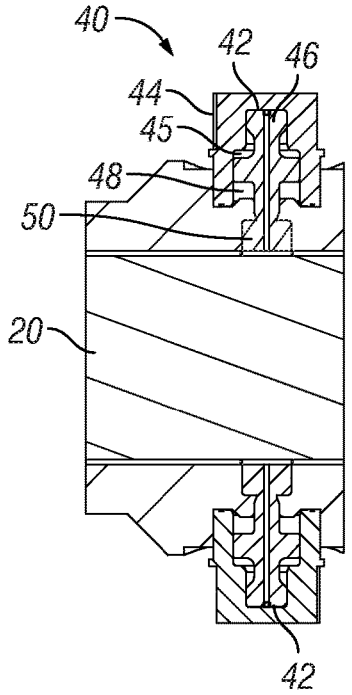
FIG. 3 shows a cross-section of the locking mechanism shown in FIG. 2.

FIGS. 2 and 3 show, respectively, an enlarged oblique view and an enlarged side view of the locking mechanism 40. In the present example embodiment, the locking mechanism 40 may comprise two lock housings 44 coupled to the pressure chamber 16, for example, on diametrically opposed sides of the pressure chamber 16. Other embodiments may comprise more or fewer lock housings; in embodiments comprising more than two such housings, the lock housings 44 may be circumferentially equally spaced around the exterior of the pressure chamber 16. The lock housing(s) 44 may comprise an internal bore 45. A locking piston 46 may be disposed in the internal bore 45. An end of the locking piston 46 oriented inwardly toward the interior of the pressure chamber 16 may comprise a locking dog, plate or similar locking element 50, which, when moved into the interior of the chamber (16 in FIG. 1) by movement of the locking piston 46, may restrain the ram 20 and piston (18 in FIG. 1) from moving back toward their respective axial positions prior to actuation of the BOP (10 in FIG. 1). The lock housing 44 and locking piston 46 may define an actuation chamber 42 to which pressure from the pyrotechnic charge (24 in FIG. 1) or other source of fluid pressure (fluid in the present context including liquid and/or gas) may be directed to urge the locking piston 46 inwardly toward the pressure chamber (16 in FIG. 1). In the present embodiment, a through passage (46A in FIG. 6) may enable passage of gas pressure from the pressure chamber 16 to the actuation chamber 42 when the piston (18 in FIG. 1) moves past the locking piston 46, thus exposing one end of the through passage (46A in FIG. 6) to the pressure chamber 16. In some embodiments, the locking piston(s) 46 may be extended so that the locking element 50 is displaced into the pressure chamber 16 by means of springs, motor and jack screw or any other type of linear actuator.

Prior to actuation of the pyrotechnic charge (24 in FIG. 1) and subsequent movement of the actuating piston (18 in FIG. 1) and the ram 20, the locking plate(s) 50 and locking piston(s) 46 may be held in a retracted position in the lock housing(s) 44, e.g., by the ram 20. In the present example embodiment, a reopening chamber 48 may be defined by the locking piston(s) 46 on a side opposed to the actuation chamber(s) 42. When fluid pressure is applied to the reopening chamber 48, the locking piston 46 will be urged to move away from the pressure chamber 16, thereby enabling opening the locking plate 50. When the locking plate 50 is reopened, the actuating piston 18 and the ram 20 may be moved into the pressure chamber 16 in the direction of the end cap (23 in FIG. 1), i.e., in the direction opposed to their movement when the actuating piston 18 is moved to close the BOP (10 in FIG. 1).

Figure 4:
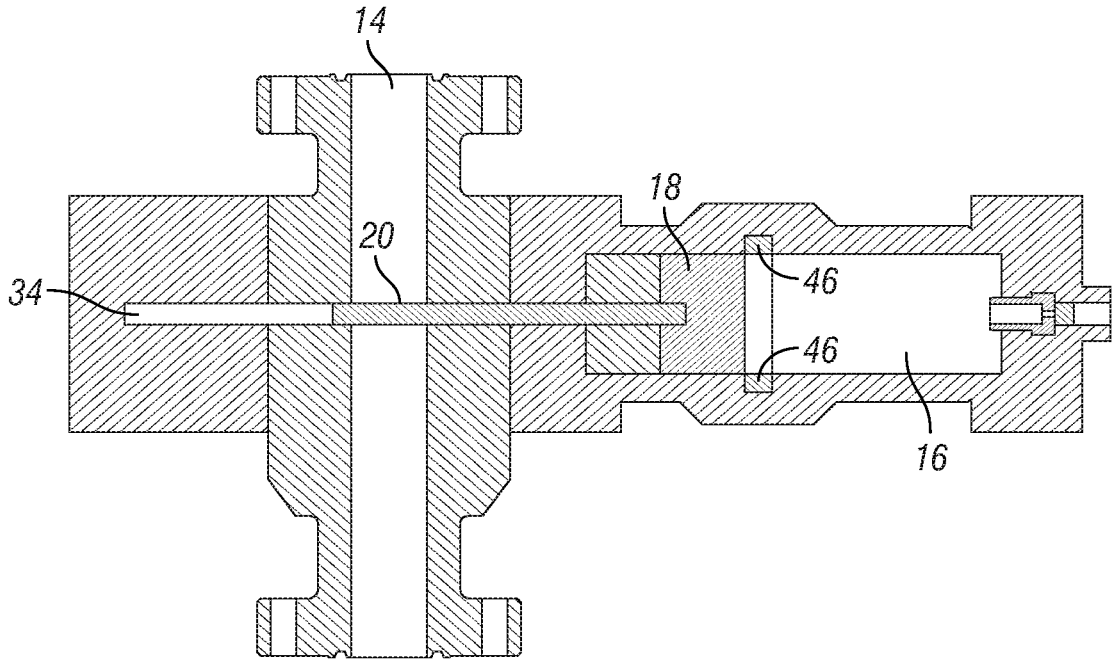
FIG. 4 shows the BOP of FIG. 1 after actuation of a pyrotechnic charge.
Figure 5:
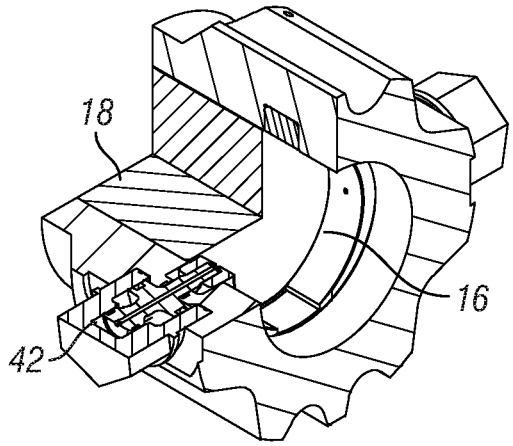
FIGS. 5 and 6 show corresponding views to FIGS. 2 and 3 after actuation of the pyrotechnic charge.
Figure 6:
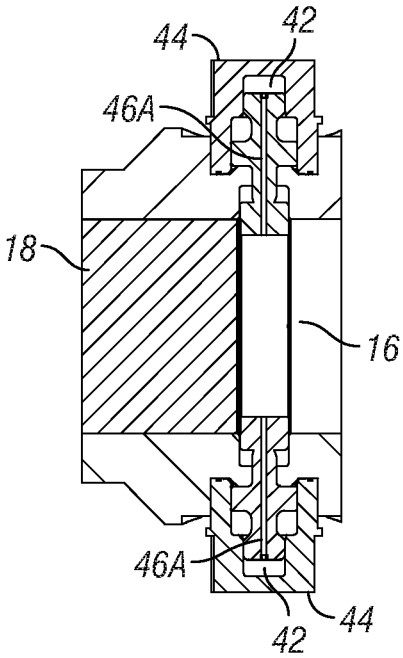

In FIGS. 4, 5, and 6, the pyrotechnic charge 24 has been actuated and the actuating piston 18 has been urged by gas pressure to travel past the locking plate(s) 50. The through passage 46A in the locking piston 46 now allows the passage of pressurized gas in the pressure chamber 16 to move into the actuation chamber 42. The gas pressure forces the locking piston(s) 46 to move toward the pressure chamber 16, thereby causing the locking plate(s) 50 to enter the pressure chamber 16 and restrict the opening in the pressure chamber 16 behind the actuating piston 18. With the locking plate(s) 50 in such position behind the actuating piston 18, the actuating piston 18 cannot be retracted toward the end cap (23 in FIG. 4). Thus, any force such as may be caused by fluid pressure in the through bore 14 entering the pressure chamber 16 and urging the ram 20 and/or actuating piston 18 to retract will not be effective to retract the actuating piston 18 and the ram 20 because of the presence in the pressure chamber 16 of the locking plate(s) 50.

While an arrangement as described herein using gas pressure from the actuation of a pyrotechnic charge has been depicted, the locking piston(s) 46 could as well be activated by a separate gas generation event or device, hydraulic and/or pneumatic pressure, a motor operating a screw jack, springs or any other linear actuating device to urge the locking piston(s) 46 to move longitudinally. A possible advantage of the arrangement explained with reference to FIGS. 2 and 3 is that actuating pressure is excluded from the locking piston(s) 46 by way of the actuating piston 18, whereby inadvertent operation of the locking mechanism 40 may be avoided. Further, FIGS. 2 and 4 show that in the present embodiment, the locking pistons 46 and locking plates 50 may be disposed in the plane of the ram 20, whereby presence of the ram 20 adjacent to the locking plates 50 as shown in FIG. 2 may also serve to avoid inadvertent inward movement of the locking pistons 46 and locking plates 50.

Figure 7:
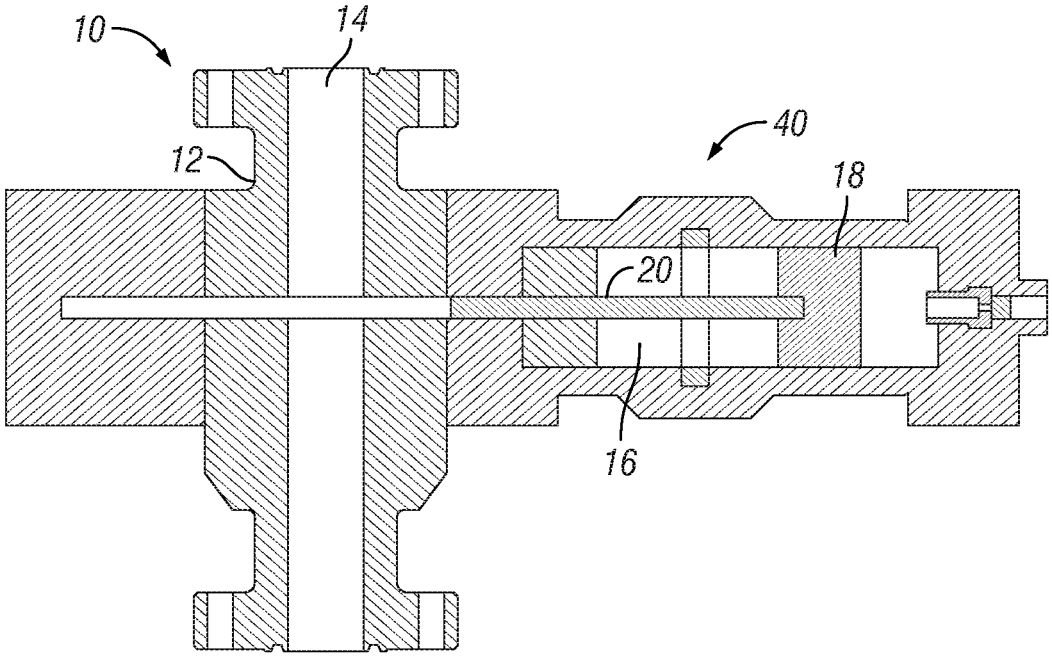
FIG. 7 shows the BOP of FIG. 4 after reopening the locking mechanism of FIGS. 5 and 6 and subsequently retracting the closure element.
Figure 8:
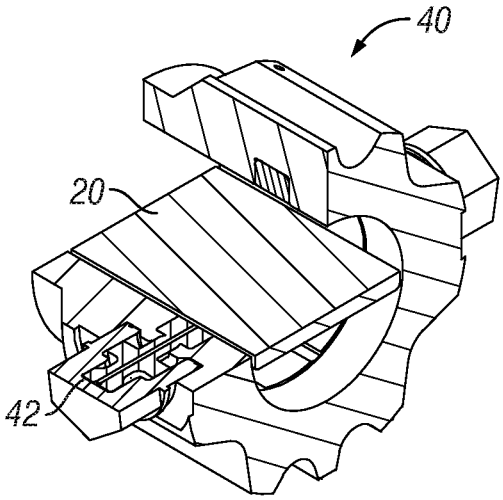
FIGS. 8 and 9 show views corresponding to FIGS. 5 and 6 after opening the locking mechanism.
Figure 9:
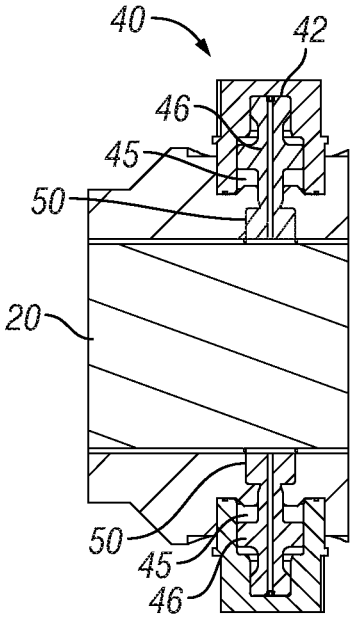

When required by operating conditions, hydraulic or other fluid pressure may be applied to the reopening chamber 48. This fluid pressure will retract the locking piston 46 and the locking plate 50, thereby allowing the actuating piston 18 and the ram 20 to be retracted. The foregoing is shown in FIGS. 7, 8 and 9, which show views corresponding to those in FIGS. 6, 7 and 8, respectively after such fluid pressure is applied to the reopening chamber 48. In some embodiments, the locking piston(s) 46 may comprise a larger area in fluid communication with the reopening chamber 48 than the area in fluid communication with the actuation chamber 42. In such embodiments, the reopening chamber 48 may be configured to provide a larger area compared to the actuation chamber 42. By having such areas in fluid communication, it is possible to operate the locking piston(s) 46 to retract using lower fluid pressure than the fluid pressure in the pressure chamber 16.

Figure 10:
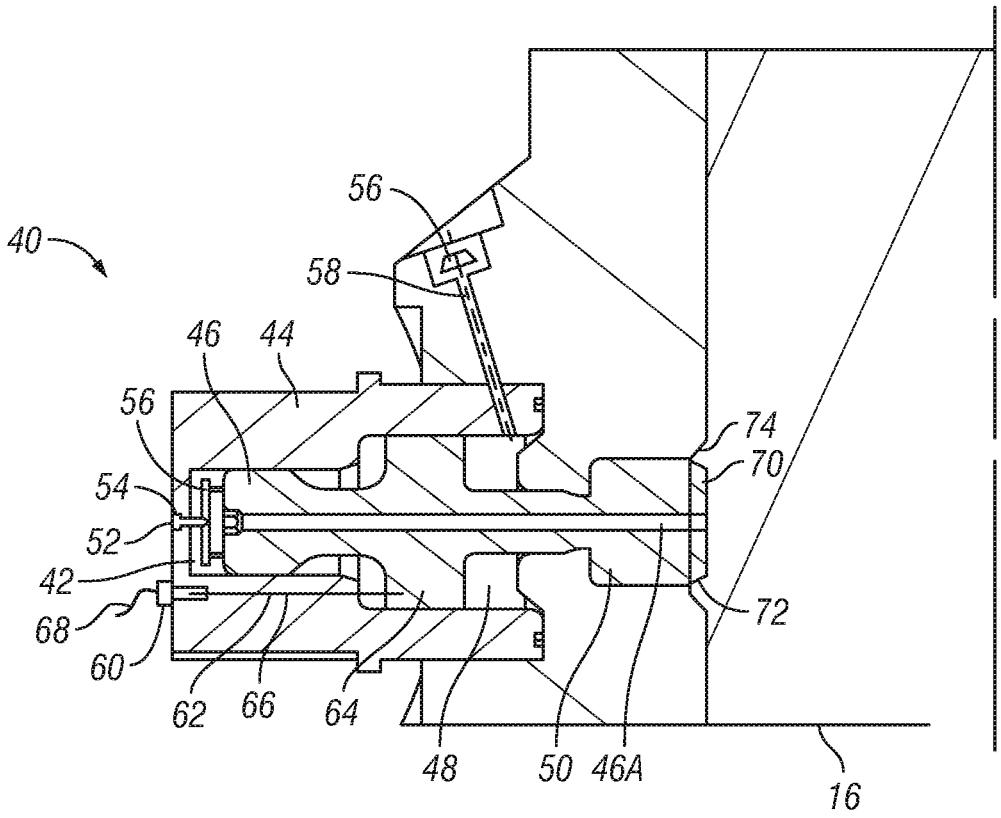
FIG. 10 shows a side view of another locking mechanism according to the present disclosure.

FIG. 10 shows an enlarged side view of another locking mechanism 40 embodiment of this disclosure. In this embodiment, a shear pin 52 is disposed through an orifice 54 at the distal end of the lock housing 44. The shear pin 52 is affixed to a bracket 56 attached to the end of the locking piston 46 opposite the locking element 50. As known by those skilled in the art, conventional shear pins 52 of selected shear strength may be used in implementations of the disclosed embodiments. The shear pin 52 retains the locking piston 46 rigidly in place until enough fluid pressure builds in the actuation chamber 42, urging the locking piston 46 inwardly toward the pressure chamber 16 until the pin shears and the piston is free to move. Although not shown in FIG. 10, it will be understood that a second locking mechanism 40 may be disposed on the diametrically opposed side of the pressure chamber 16 (See FIG. 9). In some embodiments, the orifice 54 at the distal end of the lock housing 44 may be offset from alignment with the central axis of the locking piston 46 and the shear pin 52 may be affixed directly to the end of the piston, leaving the through passage 46A unobstructed. In yet other embodiments, the shear pin 52 may be affixed to the side of the locking piston 46 through an orifice formed at the side of the lock housing 44 (not shown).

Some embodiments may be implemented with a conventional pressure sensor 56 mounted on the housing to determine the fluid pressure in the reopening chamber 48. The pressure sensor 56 is in fluid communication with the reopening chamber 48 via a channel 58 formed in the housing. Such an embodiment provides a direct indication of the fluid pressure in the reopening chamber 48. When the locking piston 46 moves toward the pressure chamber 16, the fluid pressure in the reopening chamber 48 rises. This allows for direct confirmation of the position of the locking piston 46. Some embodiments may also include an electrical switch 60 mounted at the distal end of the lock housing 44 to receive an indicator pin 62 affixed to a lobe 64 on the locking piston 46 (e.g., via a threaded engagement). The indicator pin 62 moves through an orifice 66 formed in the body of the lock housing 44. When the locking piston 46 is in the seated or retracted position (i.e., not extended into the pressure chamber 16), the indicator pin 62 end is in positive contact with the switch 60. When the locking piston 46 extends into the pressure chamber 16, the indicator pin 62 end disengages from the switch 60. A lead 68 conveys the signal from the switch 60 to provide direct indication of the locking piston 46 position. Embodiments may be implemented with both the pressure sensor 56 and the switch 60/pin 62 combination, or with only one such locking piston position indicator means. It will be appreciated by those skilled in the art that the signals from the pressure sensor 56 and/or the electrical switch 60 may be conveyed to the desired location via traditional cabling or wirelessly via conventional communication means.

In some embodiments, the leading edge 70 of the locking element 50 comprises a shear plate, formed with a material having a low hardness factor (e.g., composites, etc.). With such implementations, if the locking piston 16 unintentionally extends or the locking element 50 enters the pressure chamber 16 prematurely in the path of the ram 20 or actuating piston 18, the shear plate leading edge 70 will give way and shear off, avoiding a system failure. The leading edge 70 may be formed by affixing a low hardness segment to the end of the locking element 50 (e.g., via suitable adhesive, mechanical engagement, etc.), by treating the end of the element (e.g., chemically), or any other suitable means as known in the art. Some embodiments may also be implemented with the leading edge 70 of the locking element 50 having a slight taper 72 formed on the tip of each side. As shown in FIG. 10, some embodiments may also be formed with the inner surface of the pressure chamber 16 having a slight taper 74 formed at both edges of the locking element 50 port.

In light of the principles and example embodiments described and illustrated herein, it will be recognized that the example embodiments can be modified in arrangement and detail without departing from such principles. It will be appreciated by those skilled in the art that embodiments of this disclosure may be implemented using conventional materials, hardware, and components (e.g., suitable conventional seals) as known in the art. Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A well pressure control device, comprising:

a housing having a through bore;

a pressure chamber adjacent to one end of the housing transversely to the through bore;

a fluid pressure source disposed at one end of the pressure chamber;

a closure element disposed in the pressure chamber; and at least one locking element disposed at an axial position along the pressure chamber and configured to move into a travel path of the closure element when the closure element is moved toward the through bore;

wherein the at least one locking element comprises a locking piston disposed in a lock housing;

wherein the locking piston comprises a through hole configured to conduct fluid pressure in the pressure chamber to one side of the locking piston defining an actuation chamber.

2. The device of claim 1 further comprising a reopening chamber defined by the locking piston and the lock housing on a side of the locking piston opposed to the actuation chamber.

3. The device of claim 2 wherein the reopening chamber is larger than the actuation chamber.

4. The device of claim 1 wherein the fluid pressure source comprises a pyrotechnic gas generator charge.

5. The device of claim 1 further comprising indicator means configured to provide an indication of the position of the locking piston.

6. The device of claim 1 wherein at least one edge of the locking piston comprises a shearable plate.

7. A method for operating a well pressure control device, comprising:

applying fluid pressure to at least one closure element in a pressure chamber to urge the at least one closure element toward a through bore in a pressure control housing;

at a selected position along a travel path of the at least one closure element, diverting some of the fluid pressure to at least one locking element disposed along the pressure chamber;

wherein the at least one locking element comprises a locking piston disposed in a lock housing;

wherein the locking piston comprises a through hole whereby the diverted fluid pressure is conducted to one side of the locking piston; and moving the at least one locking element into the travel path behind the at least one closure element.

8. The method of claim 7 further comprising applying fluid pressure to a reopening chamber defined by the locking piston and the lock housing.

9. The method of claim 8 wherein one side of the locking piston defines an actuation chamber which is smaller than the reopening chamber.

10. The method of claim 7 wherein the applying fluid pressure comprises actuating a pyrotechnic charge.

11. The method of claim 7 wherein the lock housing comprises indicator means configured to provide an indication of the position of the locking piston.

12. The method of claim 7 wherein at least one edge of the locking piston comprises a shearable plate.

* * * * *